US010981025B2

(12) United States Patent
Ostler

(10) Patent No.: US 10,981,025 B2
(45) Date of Patent: Apr. 20, 2021

(54) FIRE HOSE CLEANING DEVICE

(71) Applicant: Joshua Ostler, Queen Creek, AZ (US)

(72) Inventor: Joshua Ostler, Queen Creek, AZ (US)

( * ) Notice: Subject to any disclaimer, the term of this patent is extended or adjusted under 35 U.S.C. 154(b) by 0 days.

(21) Appl. No.: 16/239,331

(22) Filed: Jan. 3, 2019

(65) Prior Publication Data

US 2020/0215369 A1 Jul. 9, 2020

(51) Int. Cl.
*A62C 33/02* (2006.01)
*B08B 9/023* (2006.01)

(52) U.S. Cl.
CPC ..... *A62C 33/02* (2013.01); *B08B 9/023* (2013.01); *B08B 2209/02* (2013.01)

(58) Field of Classification Search
CPC ..... B08B 9/023; A62C 27/00; B60R 9/00–12; B60R 2011/0082; B60R 2011/0085–0089; B60R 2011/0094; B60R 2011/0096; B60D 7/00; B60D 2001/548; B60D 1/54
See application file for complete search history.

(56) References Cited

U.S. PATENT DOCUMENTS 2,651,312 A 6/1951 McBeth
4,280,672 A * 7/1981 Santos ..... B65H 54/585 242/534.2
5,040,259 A * 8/1991 Ishii ..... A62C 33/02 134/113
5,881,419 A 3/1999 Millard
6,487,750 B1 * 12/2002 Brown ..... A62C 33/02 134/122 R
2005/0011979 A1 * 1/2005 Best ..... A62C 33/02 242/370
2017/0343308 A1 * 11/2017 Wojciechowski ..... F28G 1/163

OTHER PUBLICATIONS

Merriam-Webster.com Dictionary, s.v. "Internet of Things," accessed Jul. 21, 2020, https://www.merriam-webster.com/dictionary/Internet%20of%20Things. (Year: 2020).*

* cited by examiner

*Primary Examiner* — Michael E Barr
*Assistant Examiner* — Omair Chaudhri
(74) *Attorney, Agent, or Firm* — Griffiths & Seaton PLLC

(57) ABSTRACT

A fire hose cleaning device that includes a washing frame comprising a piping system having one or more spray apertures for discharging a liquid to clean a fire hose. The piping system comprising a base pipe section, a top pipe section disposed in parallel alignment with the base pipe section, and two or more side pipe sections disposed in parallel alignment coupled to the base section and the top section. The washing frame may include a hose adapter. The hose adapter may connect to an open end of a hose to receive a liquid to pass through the washing frame. The washing frame may include one or more hose reception devices coupled to the two or more side pipe sections. The one or more hose reception devices enables a fire hose to be positioned thereon and selectively pass through the washing frame while being sprayed with the liquid.

20 Claims, 8 Drawing Sheets

FIRE HOSE CLEANING DEVICE

BACKGROUND

In today's society, a major focus within the fire-fighting industry revolves around keeping fire fighters safe, minimizing exposure to harmful substances, and the care and maintenance of personal protective equipment (PPE). In addition, increased concern and focus is now on the safety and cleanliness of additional fire station equipment such as, for example, fire hoses. For example, each time a fire hose is used in emergency response situations, the fire hose may be exposed to harmful chemicals (e.g., "carcinogens"), dirt, debris, soot, ash, or other hazardous substances. That is, the fire hose may become soiled during use with the carcinogens, dirt, debris, soot, ash, or other hazardous substances. If not cleaned, emergency response personnel may be exposed to harmful substances and the fire hose may grow mold and mildew and even expose the emergency response personnel (e.g., a firefighter) to dangerous occupational hazards such as, the dangerous carcinogens.

Often times, however, attempts to clean a fire hose associated with a fire truck "on scene" (e.g., at the location of a fire or emergency) or at a fire station are futile as hoses are often left on the ground while attempting to clean off debris from the hose. If the ground surface contains various harmful chemicals, dirt, debris, soot, ash, or other hazardous substances, the attempts to entirely clean the fire hose may be futile, which compromises the health and safety of persons if a contaminated hose is stored or transported on the vehicle. A need exists for a device that quickly and efficiently cleans a hose to minimize potential risks to potential users.

SUMMARY

Various embodiments are provided for a fire hose cleaning device. The fire hose cleaning device includes a washing frame comprising a piping system having one or more spray apertures for discharging a liquid to clean a fire hose. The piping system comprising a base pipe section, a top pipe section disposed in parallel alignment with the base pipe section, and two or more side pipe sections disposed in parallel alignment coupled to the base section and the top section. The washing frame may include one or more hose adapters coupled to the washing frame. The one or more hose adapters may be configured to connect to an open end of a hose to receive a liquid to pass through the washing frame. The washing frame may include one or more hose reception devices coupled to the two or more side pipe sections. The one or more hose reception devices enables a fire hose to be positioned thereon and selectively pass through the washing frame while being sprayed with the liquid.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1A:
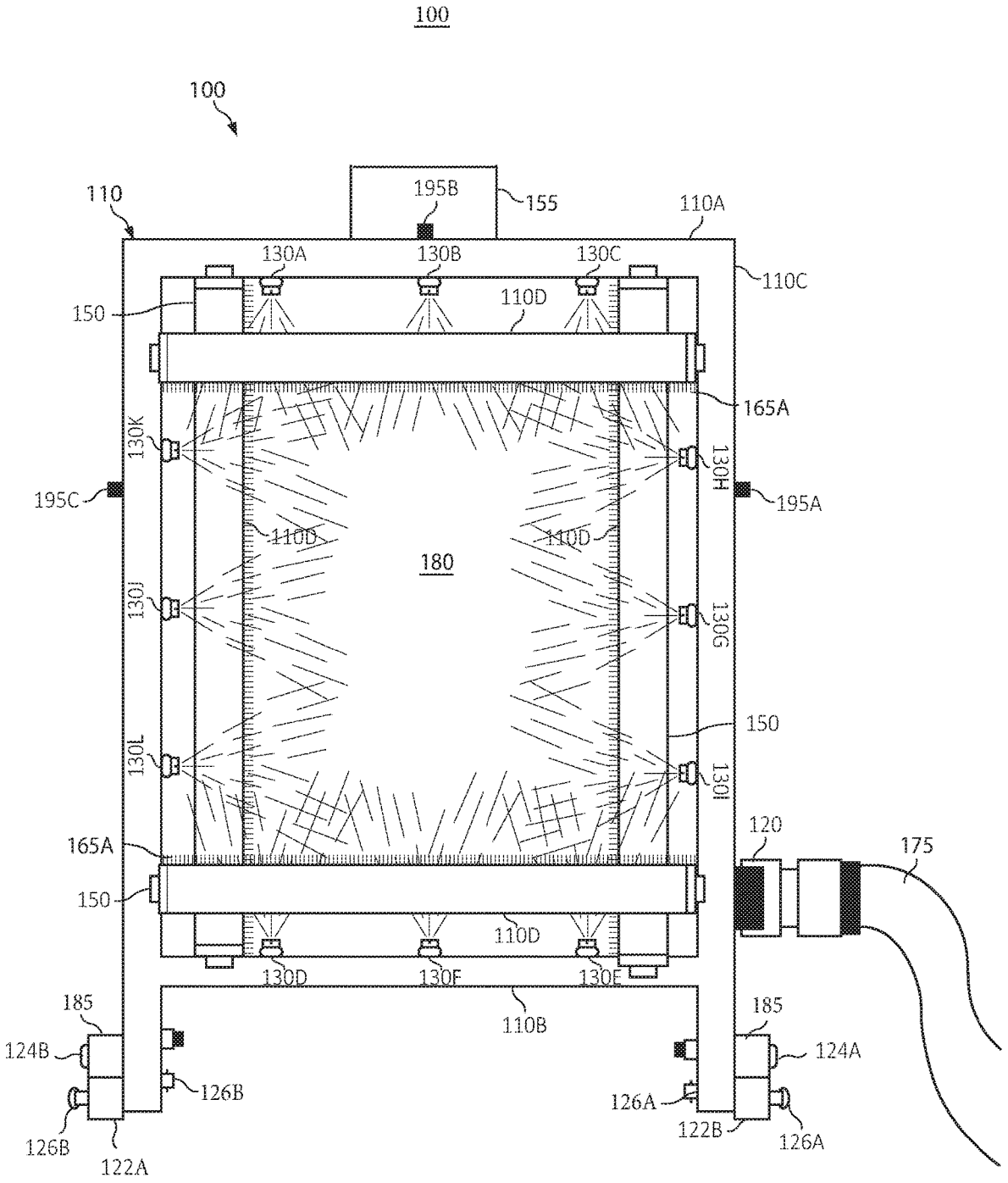
FIG. 1A is a perspective view a fire hose washing device according to one embodiment of the present invention.

The following detailed description of the invention merely provides exemplary embodiments and is not intended to limit the invention or the application and uses of the invention. Furthermore, there is no intention to be bound by any theory presented in the preceding background of the invention or the following detailed description of the invention.

Before the disclosed embodiments are described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples or embodiments only and is not intended to be limiting. The same reference numerals in different drawings represent the same element. Numbers provided in flow charts and processes are provided for clarity in illustrating steps and operations and do not necessarily indicate a particular order or sequence.

Furthermore, the described features, structures, or characteristics can be combined in any suitable manner in one or more embodiments. In the following description, numerous specific details are provided, such as examples of layouts, distances, network examples, etc., to provide a thorough understanding of various technology embodiments. One skilled in the relevant art will recognize, however, that such detailed embodiments do not limit the overall inventive concepts articulated herein, but are merely representative thereof.

As used in this specification and the appended claims, the singular forms "a," "an" and "the" include plural referents unless the context clearly dictates otherwise. Thus, for example, reference to "a pipe" includes a plurality of such pipes.

Reference throughout this specification to "an example" means that a particular feature, structure, or characteristic described in connection with the example is included in at least one invention embodiment. Thus, appearances of the phrases "in an example" or the like in various places throughout this specification do not necessarily all refer to the same embodiment.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various invention embodiments and examples can be referred to herein along with alternatives for the various components thereof. It is understood that such embodiments, examples, and alternatives are not to be construed as defacto equivalents of one another, but are to be considered as separate and autonomous representations under the present disclosure.

Furthermore, the described features, structures, or characteristics can be combined in any suitable manner in one or more embodiments. In the following description, numerous specific details are provided, such as examples of layouts, distances, network examples, etc., to provide a thorough understanding of invention embodiments. One skilled in the relevant art will recognize, however, that the technology can be practiced without one or more of the specific details, or with other methods, components, layouts, etc. In other instances, well-known structures, materials, or operations may not be shown or described in detail to avoid obscuring aspects of the disclosure.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term in this specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

As used herein, comparative terms such as "increased," "decreased," "better," "worse," "higher," "lower," "enhanced," "improved," and the like refer to a property of a device, component, or activity that is measurably different from other devices, components, or activities in a surrounding or adjacent area, in a single device or in multiple comparable devices, in a group or class, in multiple groups or classes, or as compared to the known state of the art. For example, a process that provides "improved" efficiency is a process that requires less time or energy to perform the process than to perform the same or a similar state of the art process. A number of factors can cause such increased risk, including location, fabrication process, number of program pulses applied to the region, etc.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. However, it is to be understood that even when the term "about" is used in the present specification in connection with a specific numerical value, that support for the exact numerical value recited apart from the "about" terminology is also provided.

Numerical amounts and data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 1.5, 2, 2.3, 3, 3.8, 4, 4.6, 5, and 5.1 individually.

This same principle applies to ranges reciting only one numerical value as a minimum or a maximum. Furthermore, such an interpretation should apply regardless of the breadth of the range or the characteristics being described.

Example Embodiments

An initial overview of technology embodiments is provided below and then specific technology embodiments are described in further detail later. This initial summary is intended to aid readers in understanding the technology more quickly, but is not intended to identify key or essential technological features nor is it intended to limit the scope of the claimed subject matter. Unless defined otherwise, all technical and scientific terms used herein have the same meaning as commonly understood by one of ordinary skill in the art to which this disclosure belongs.

In one aspect, the illustrated embodiments provide solutions to the aforementioned challenges of cleaning a fire hose. In one aspect, the present invention provides for a fire hose cleaning device includes a washing frame comprising a piping system having one or more spray apertures for discharging a liquid to clean a fire hose. The piping system comprising a base pipe section, a top pipe section disposed in parallel alignment with the base pipe section, and two or more side pipe sections disposed in parallel alignment coupled to the base section and the top section. The washing frame may include one or more hose adapters coupled to the washing frame. The one or more hose adapters may be configured to connect to an open end of a hose to receive a liquid to pass through the washing frame. The washing frame may include one or more hose reception devices coupled to the two or more side pipe sections. The one or more hose reception devices enables a fire hose to be positioned thereon and selectively pass through the washing frame while being sprayed with the liquid (e.g., water dispersed at between 50 pounds per square inch ("psi") and 150 psi).

Turning to the FIGS. 1A-1D, diagrams 10, 125, 135, and 145 depict a fire hose cleaning device 100 according to one embodiment of the present invention. The fire hose cleaning device 100 may be a washing frame 110 formed from a piping system. The washing frame 110 may include one or more spray apertures 130A-L for discharging a liquid to clean a fire hose.

In one aspect, the fire hose cleaning device 100 may be composed of steel (e.g., steel, stainless-steel, or any combination of corrosion resistant steel), iron, sheet metal, die-cast aluminum, sheet aluminum, cast aluminum, a high-strength lightweight alloy material, any metallic material, a fiberglass material, a non-flammable material, a plastic material, a rubber material, a dense foam material, a fibrous material, a polyvinyl chloride (PVC) material, a carbon fiber, a polyurethane material, a stretchable material, a moldable material, a joint metallic and polyurethane material, a polyamide-based thermoplastic material reinforced with glass fibers and/or mineral matter, a magnetic material, a glass material, a ceramic material, and/or any other material or combination of materials, which are suitable for such an application.

In one aspect, the fire hose cleaning device 100 can be fabricated by a one-component or multi-component injection-molding or vacuum molding process. For example, the fire hose cleaning device 100 can be fabricated by a one-component and/or multi-' component injection-molding or vacuum molding process in which polyamide-based thermoplastic materials are used. Alternatively, the fire hose cleaning device 100 may be fabricated using three-dimensional ("3D") printing in which one or more materials may be joined or solidified under computer control to create the fire hose cleaning device 100. Alternatively, the fire hose cleaning device 100 may be manufactured and/or fabricated using one or more machining or manufacturing operations.

The washing frame 110 may comprise a base pipe section 110B, a top pipe section 110A disposed in parallel alignment with the base pipe section 110B, and two or more side pipe sections 110C and 110D disposed in parallel alignment with each other and coupled to the base section 110B and the top section 110A. It should be noted that each reference to the washing frame 110 may simultaneously include reference to the piping system that includes the base pipe section 110B, the top pipe section 110A, the two or more side pipe sections 110C and 110D, or a combination thereof.

In one aspect, the base pipe section 110B, the top pipe section 110A, and the two or more side pipe sections 110C and 110D can be one continuous singular piece and/or four separate pieces collectively attached to each other. Thus, the base pipe section 110B, the top pipe section 110A, and the two or more side pipe sections 110C and 110D can be one singular piping system or a combination of sections that are configured in one of a plurality of geometric shapes and sizes, heights, widths, depths, and/or weights. For example, collectively, the base pipe section 110B, the top pipe section 110A, and the two or more side pipe sections 110C and 110D can be have a shape of square or rectangle. Alternatively, the base pipe section 110B, the top pipe section 110A, and the two or more side pipe sections 110C and 110D can have a shape of a circle, oval, or other shape and size according to user preference, as illustrated in only one example, of FIG. 1D.

Thus, by way of example only, the fire hose cleaning device 100 (e.g., the base pipe section 110B, the top pipe section 110A, the two or more side pipe sections 110C and 110D) illustrate a square or rectangular shape. However, other alternative geometric shapes may be designed, applied, configured, or used. For example, the base pipe section 110B, the top pipe section 110A, the two or more side pipe sections 110C and 110D may collective form a circle shape, oval shape, or other customized geometric shape according to a user preference.

In one aspect, the washing frame 110 (e.g., the base pipe section 110B, the top pipe section 110A, and the two or more side pipe sections 110C and 110D) may be specified by a nominal diameter with a constant outside diameter (OD) and a schedule that defines the thickness. The washing frame 110 (e.g., the base pipe section 110B, the top pipe section 110A, and the two or more side pipe sections 110C and 110D) may be pipe that has one or more of a plurality of shapes, sizes, and thickness. That is, the base pipe section 110B, the top pipe section 110A, and the two or more side pipe sections 110C and 110D may each have a defined/selected shape, size, and/or thickness. For example, the base pipe section 110B, the top pipe section 110A, the two or more side pipe sections 110C and 110D, or a combination thereof may each be a square-shaped pipe/tube having a certain shape, size, thickness and diameter. Alternatively, the base pipe section 110B, the top pipe section 110A, the two or more side pipe sections 110C and 110D, or a combination thereof may be oval/circular-shaped pipe/tube having a certain shape, size, thickness and diameter.

Thus, the base pipe section 110B, the top pipe section 110A, the two or more side pipe sections 110C and 110D, or a combination thereof may have a nominal diameter with a constant outside diameter (OD) and a schedule that defines the thickness. The base pipe section 110B, the top pipe section 110A, the two or more side pipe sections 110C and 110D, or a combination thereof may be specified by the OD and wall thickness, but may be specified by any two of OD, inside diameter (ID), and wall thickness. The base pipe section 110B, the top pipe section 110A, the two or more side pipe sections 110C and 110D, or a combination thereof may be manufactured to one of several international and national industrial standards. In an additional embodiment, the base pipe section 110B, the top pipe section 110A, the two or more side pipe sections 110C and 110D, or a combination thereof may have one or more custom sizes and a broader range of diameters and tolerances. The base pipe section 110B, the top pipe section 110A, the two or more side pipe sections 110C and 110D, or a combination thereof may be non-cylindrical sections, i.e., square or rectangular piping/tubing.

In one aspect, as illustrated by way of example only, the fire hose cleaning device 100 such as, for example, the washing frame 110 (e.g., the base pipe section 110B, the top pipe section 110A, and the two or more side pipe sections 110C and 110D) may be metal, plastic, or other material used to covey a selected or desired amount of liquid therein such as, for example, water. For example, the fire hose cleaning device 100 may be stainless steel, square-tubing having a height of at least 18 inches and a width of at least 12.5 inches.

In one aspect, the spray apertures 130A-L may be located in one of a plurality of locations on the washing frame 110 such as, for example, the spray apertures 130A-C may be located on the top pipe section 110A while spray apertures 130D-F may be located on the base pipe section 110B. Although not show, one or more spray apertures 130A-L may also be located on the two or more side pipe sections 110C and 110D.

In an additional aspect, the washing frame 110 such as, for example, the top pipe section 110A (or other section of the washing frame) may include one or more carrying apparatuses 155 (e.g., a handle) enabling the washing frame 110 to be manually transported by a user.

Figure 1B:
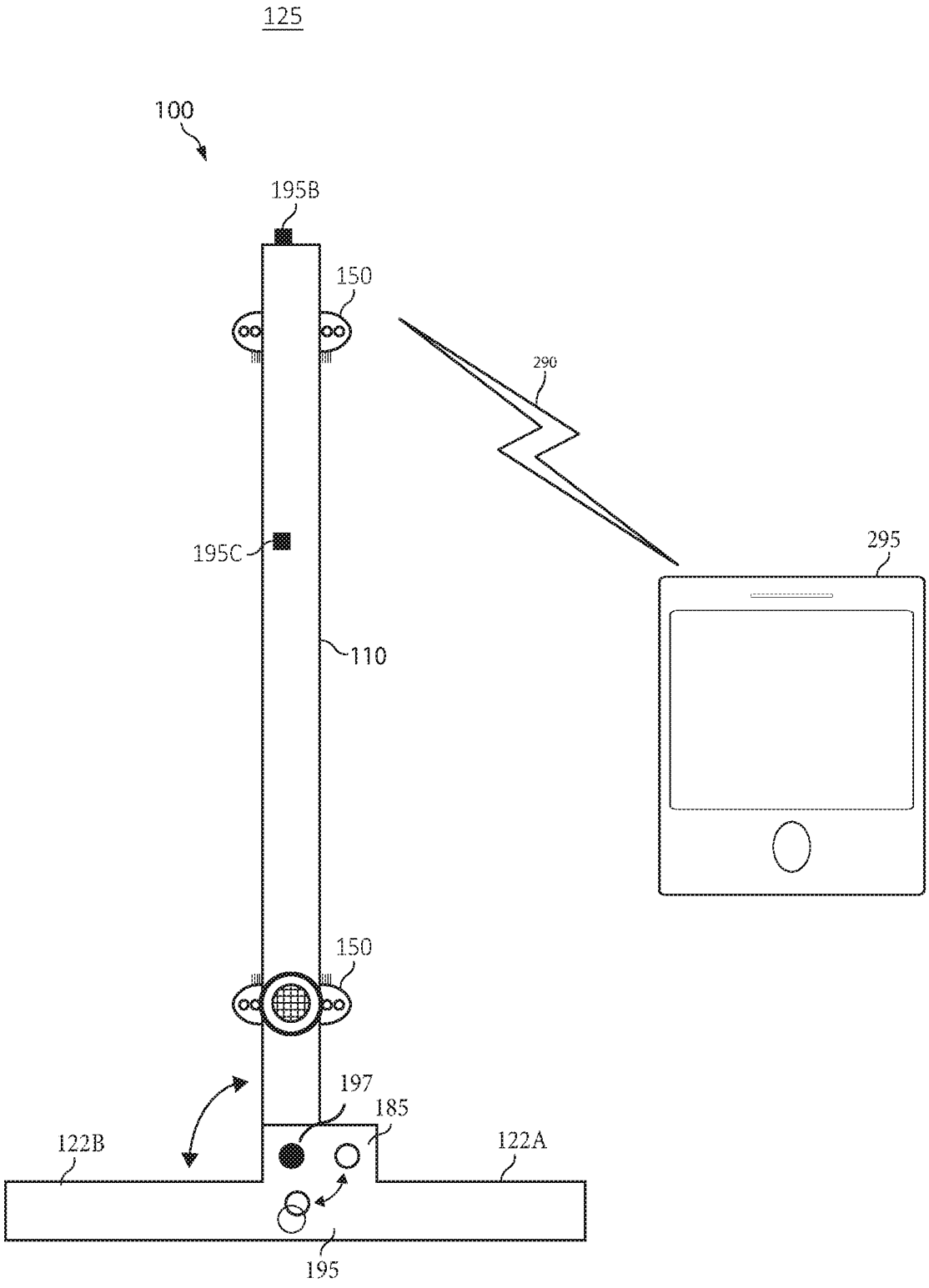
FIG. 1B is a side view of a fire hose washing device according to one embodiment of the present invention of FIG. 1A.
Figure 1C:
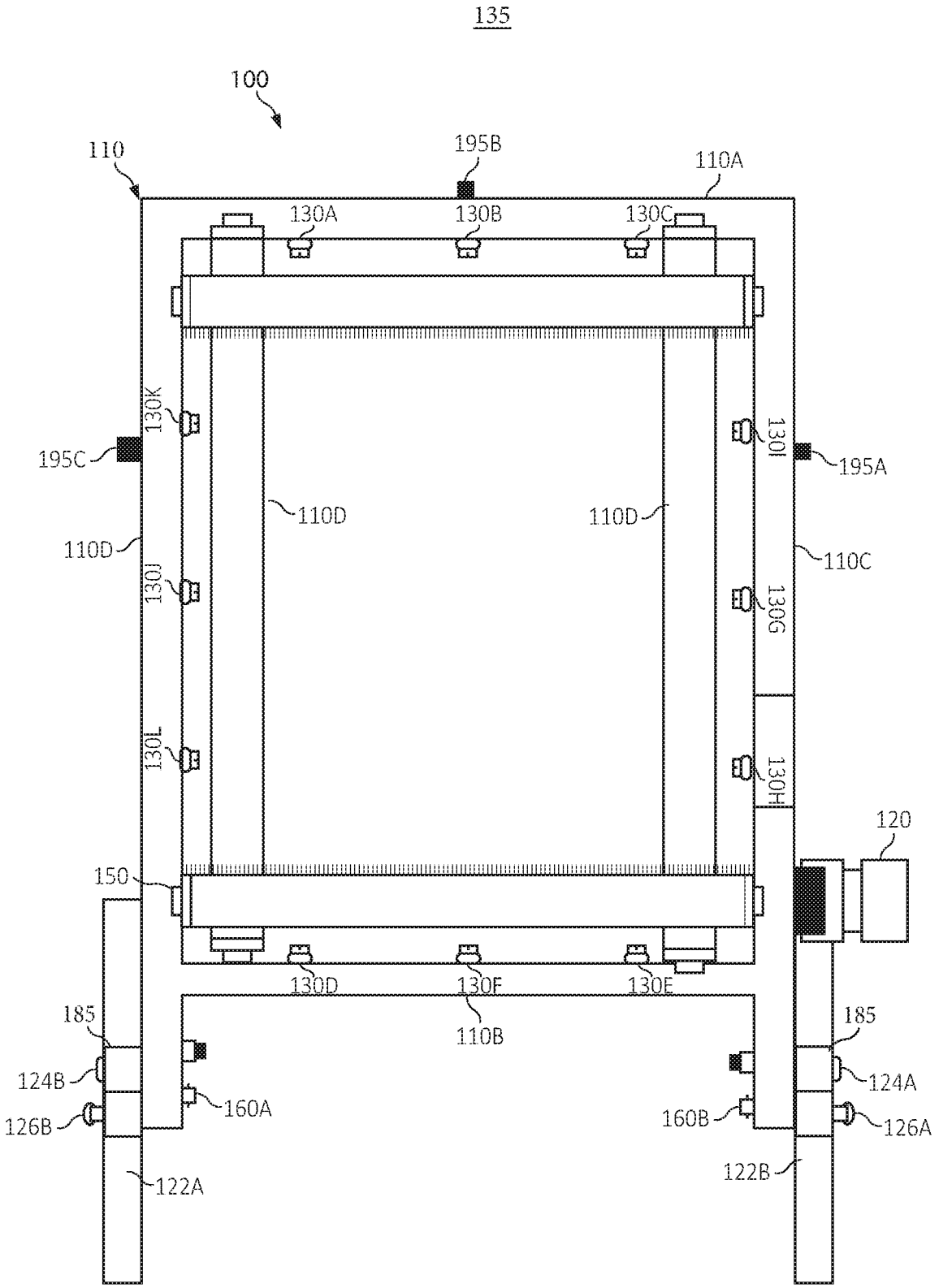
FIG. 1C is a perspective view of a fire hose washing device in a folded position according to one embodiment of the present invention of FIG. 1A.

The washing frame 110 may include one or more hose adapters 120 coupled to the washing frame 110. More specifically, for example, the one or more hose adapters 120 may be couple to the two or more side pipe sections 110C and 110D (e.g., side pipe section 110C as illustrated in FIGS. 1A-1C).

The one or more hose adapters 120 may be configured to connect to an open end of a hose 175 to receive a liquid to pass through the washing frame 110. The one or more hose adapters 120 may be a male connector and/or female receptacle coupling device configured to receive a female receptacle and/or male connector respectively. In one aspect, the one or more hose adapters 120 may be a "quick-release" connection device enabling the hose 175 (e.g., a fire hose/high-pressure hose) to be rapidly connected and released from the one or more hose adapters 120. In an alternative embodiment, the one or more hose adapters 120 may be one of a variety of types of adaptors, connectors, or attachment devices for temporarily and/or permanently securing the hose 175 to the washing frame 110 in one or more locations.

The washing frame 110 may include one or more hose reception devices 150 (e.g., a rolling pin) coupled to the two or more side pipe sections 110C and 110D. For example, the hose reception devices 150 may be located a defined distance from the base pipe section 110B and coupled to the two or more side pipe sections 110C and 110D. Alternatively, the hose reception devices 150 may be located a defined distance from the top pipe section 110A and coupled to the two or more side pipe sections 110C and 110D. In one aspect, the hose reception devices 150 may be permanently fixed to a selected position along the two or more side pipe sections 110C and 110D. In an additional aspect, the hose reception devices 150 may be configured to be adjustably positioned along the along the two or more side pipe sections 110C and 110D. The one or more hose reception devices 150 enables a fire hose (e.g., contaminated hose 220 of FIG. 2) to be positioned thereon and selectively pass through the washing frame while being sprayed with the liquid. In one aspect, the washing frame 110 may include one or more scrubbing brushes 165. More specifically, the hose reception devices 150 may include one or more scrubbing brushes 165 to assist with receiving and cleaning a hose. In one aspect, the hose reception devices 150 may a shaft, rolling pin, bar, or device capable of sliding, moving, rotating, vibrating, shaking, vacillating, or other selected movement. Also, the inner area of the washing frame 110 may form a washing zone 180 for discharging the liquid towards at least the hose reception devices 150 in the washing zone 180.

In an additional aspect, the hose reception devices 150 may be located and coupled to the base pipe section 110B and the top pipe section 110A. Thus, the hose reception devices may coupled to the base pipe section 110B and the top pipe section 110A and/or two or more side pipe sections 110C and 110D. In one aspect, one or more of the hose reception devices 150 may be coplanar and/or non-coplanar to each other and/or the base pipe section 110B and the top pipe section 110A and two or more side pipe sections 110C and 110D. For example, the hose reception devices 150 coupled to the base pipe section 110B and the top pipe section 110A may externally rotate and/or extend inward and/or outward away from the two or more side pipe sections 110A and 110B while the hose reception devices 150 coupled to two or more side pipe sections 110C and 110D may be in parallel with and coplanar with the two or more side pipe sections 110C and 110D. In this way, for example, the hose reception devices 150 coupled to the two or more side pipe sections 110C and 110D may slidably adjust/move along the two or more side pipe sections 110C and 110D without interference from the hose reception devices 150 that may be located and coupled to the base pipe section 110B and the top pipe section 110A. Similarly, the hose reception devices 150 located and coupled to the base pipe section 110B and the top pipe section 110A may slidably adjust/move along the base pipe section 110B and the top pipe section 110A without interference from the hose reception devices 150 that may be located and coupled to the two or more side pipe sections 110C and 110D.

The washing frame 110 may be coupled to one or more base sections such as, for example, adjustable base sections 122A and 122B. The one or more base sections such as, for example, adjustable base sections 122A and 122B are configured to support the washing frame 110 in a permanent and/or temporary fixed position. In one aspect, the adjustable base sections 122A and 122B may be coupled to the washing frame 110 (e.g., the two or more side pipe sections 110C and 110D at one or more locations) by one or more fastening devices 124A-B and/or 126B such as, for example, bolts 124A-B and/or removable pins 126A-B. The one or more fastening devices 124A-B and/or 126B may connect the adjustable base sections 122A and 122B to the washing frame 110 (e.g., the two or more side pipe sections 110C and 110D).

In one aspect, the adjustable base sections 122A and 122B may be oriented perpendicular (or other configuration) to the washing frame 110 providing support for enabling the washing frame to remain in a fixed, sturdy, and stable position while a high-pressure fluid is distributed throughout the washing frame 110 from hose 175 and ejected or dispersed from the spray apertures 130A-L. The amount of fluid pressure distributed throughout the washing frame 110 may be defined and/or varied according to user preference such as, for example, water dispersed at between 50 pounds per square inch ("psi") or 150 psi.

In one aspect, the one or more base sections such as, for example, adjustable base sections 122A and 122B defines a pivot axis 197 to enable the washing frame 110 to rotationally pivots via the at least one adjustable base section, as in FIG. 1B-C. For example, the washing frame 110 may be adjusted to one or more angles in relation to the adjustable base sections 122A and 122B. As illustrated in FIG. 1B, the washing frame 110 may rotate along a pivot axis formed at the adjustable base sections 122A and 122B. In one aspect, the fastening devices 124A-B (e.g., bolts 124A-B) may secure the washing frame 110 to the adjustable base sections 122A and 122B during rotation along a pivot axis. The fastening devices 126A-B, which may be removable pins 126A-B, may be released and reconnected to enable the washing frame 110 to rotate about the pivot axis created by the fastening devices 124A-B. Thus, as illustrated in FIG. 1C, the washing frame 110 may be rotated to a "folded" or "compact" position whereby the washing frame 110 is parallel with the adjustable base sections 122A and 122B.

In one aspect, the adjustable base sections 122A and 122B may be a single pipe having a defined size, shape, height, and/or length and made of one of a plurality of materials. For example, the adjustable base sections 122A and 122B may be stainless-steel tubing similar to the size, shape, and/or material of the washing frame 110. The adjustable base sections 122A and 122B may be a pipe tubing (e.g., square tubing) which may be hollow and/or solid having a define length such as, for example, a length of at least 12 inches. The adjustable base sections 122A and 122B may be a t-shape (e.g., a reverse T-shape). Thus, reverse T-shape may be a fin-like section (e.g., a fin 185) extending from the main sections 195 of the adjustable base sections 122A and 122B. In one aspect, the adjustable base sections 122A and 122B may be coupled directly to the fin 185. Thus, in one aspect, the washing frame may be rotated to a "folded" or "compact" position whereby the washing frame 110 is parallel with the adjustable base sections 122A and 122B. However, by connecting the washing frame 110 to the fin 185, the washing frame 110 may be non-coplanar with the adjustable base sections 122A and 122B while being folded or in the compact position as illustrated in FIGS. 1B and 1C.

In an additional aspect, the washing device 110 may include one or more computing devices 195A-C devices (e.g., a sensor and/or internet of things (IoT) devices) positioned in one or more locations. For example, the computing devices 195A-C may be IoT sensor-based devices 195A-C and be located at one of a variety of positions/locations on the base pipe section 110B, the top pipe section 110A, the two or more side pipe sections 110C and 110D, or a combination thereof. The one or more computing devices 195A-C devices may be in communication with computing environment 12, by one or more communication methods, such as a computing network. In one example, the computing environment 12 may be controlled by a user associated with the computing environment 12. In another example, the computing environment 12 may be completely independent from the user of the fire hose cleaning device 100.

Thus, the one or more computing devices 195A-C devices may be activated and/or enabled to automatically deliver a desired/selected amount of water through the washing frame 110. That is, the one or more computing devices 195A-C devices may detect the presence of a hose within the washing device 110 and/or detect a hose within a selected distance from the washing device 110 and automatically trigger the spray apertures 130A-L to eject, disperse, or release the water traversing within the washing frame 110 at one or more angles and/or at one or more flow rates.

Figure 2:
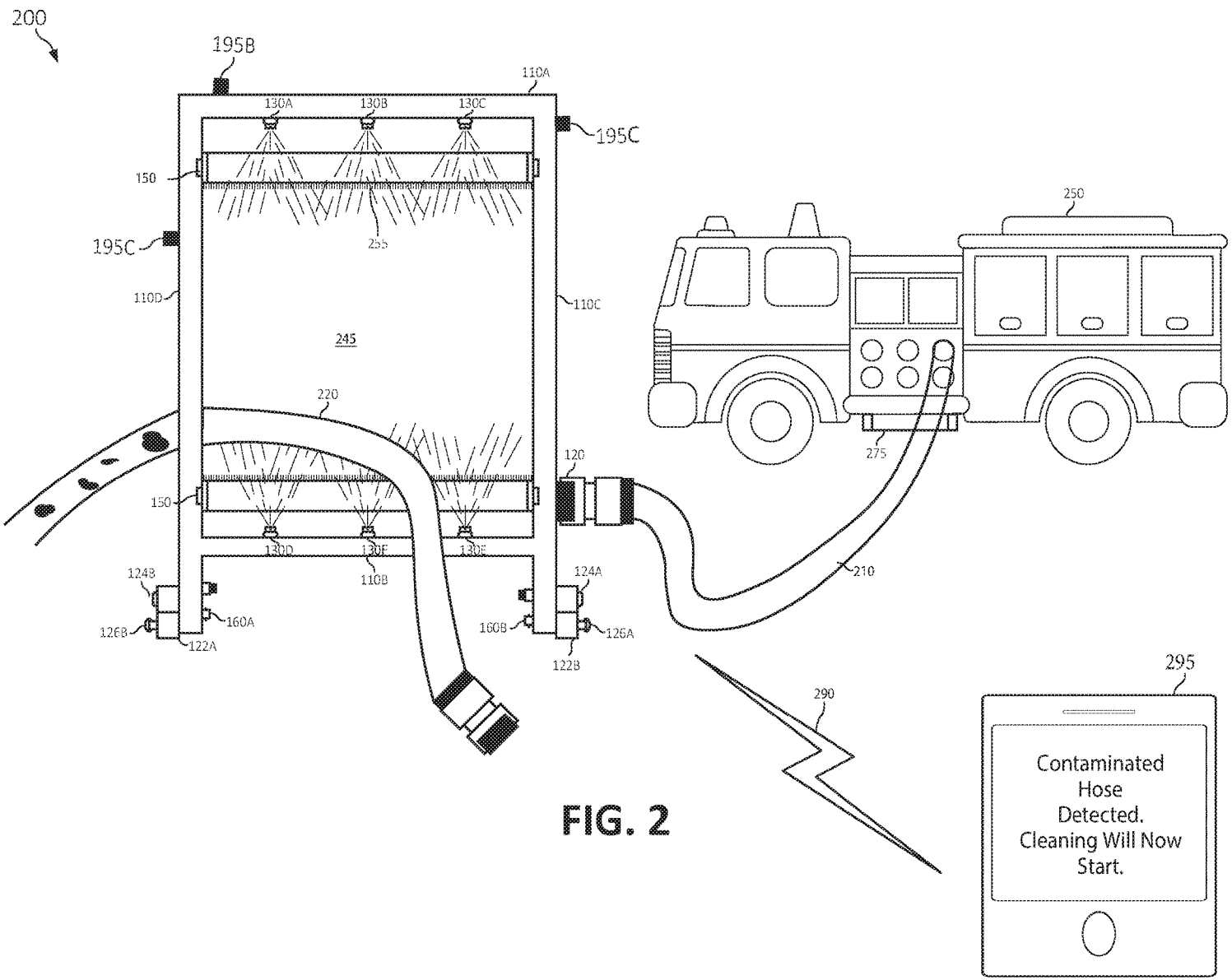
FIG. 2 is a view a fire hose washing device coupled to a hose of a vehicle according to one embodiment of the present invention of FIG. 1A.

The one or more computing devices 195A-C may be in communication with an IoT communication network via network or communication link 290 (as illustrated in FIG. 1B and FIG. 2). In one aspect, the one or more computing devices 195A-C may be proximity sensors, cameras, radio frequency identification "RFID" readers, biometric sensors, wearable sensors, computers, interactive-voice detection system, wireless communication equipment, handheld devices (e.g., Global Positioning System "GPS" device or step counters), and/or other audible, camera, or sensor-based devices. The one or more computing devices 195A-C may also be IoT cameras or sensor-based devices and may receive and/or detect various types of activities such as, for example, activities/data relating to detection of a hose at or near the washing device 110 and/or attachment/detachment of the fire hose cleaning device 100 from a vehicle (e.g., vehicle 250 of FIG. 2).

The one or more computing devices 195A-C may also be used for communicating the detected data to a user equipment ("UE") 295 (e.g., a smart phone, smart watch, computer, tablet, etc. as illustrated in FIG. 1B and FIG. 2) via network or communication link 290 to enable to a user to wirelessly control the activation and deactivation of the liquid through the washing device 110 via the spray apertures 130A-L. For example, one or more computing devices 195A-C may detect a hose entering the washing zone 180. In one aspect, the one or more computing devices 195A-C may trigger a signal to a UE 295, which may be enable with an application in communication with the fire hose cleaning device 100. The application may be enabled to automatically trigger the release and/or activation of liquid through the washing device 110 via the spray apertures 130A-L. Alternatively, for example, the application may be located on one or more computing devices 195A-C, which may automatically trigger the release and/or activation of liquid through the washing device 110 via the spray apertures 130A-L.

In one aspect, one or more computing devices 195A-C may also be may be in communication with a vehicle or vehicular computing system so as to include using images, video, sounds, or other sensor-based device data. The data may be combined to form a 360-degree view of the vehicle (e.g., vehicle 250 of FIG. 2) capable of being displayed such as, for example, in a display system of the vehicle and a UE 295. The vehicle communication system of the vehicle (e.g., vehicle 250 of FIG. 2) may relay and communicate (via communication link 290) information to one or more computing devices 195A-C and/or UE 295, which may automatically signal the activation and/or deactivation of the fire hose cleaning device 100.

Figure 1D:
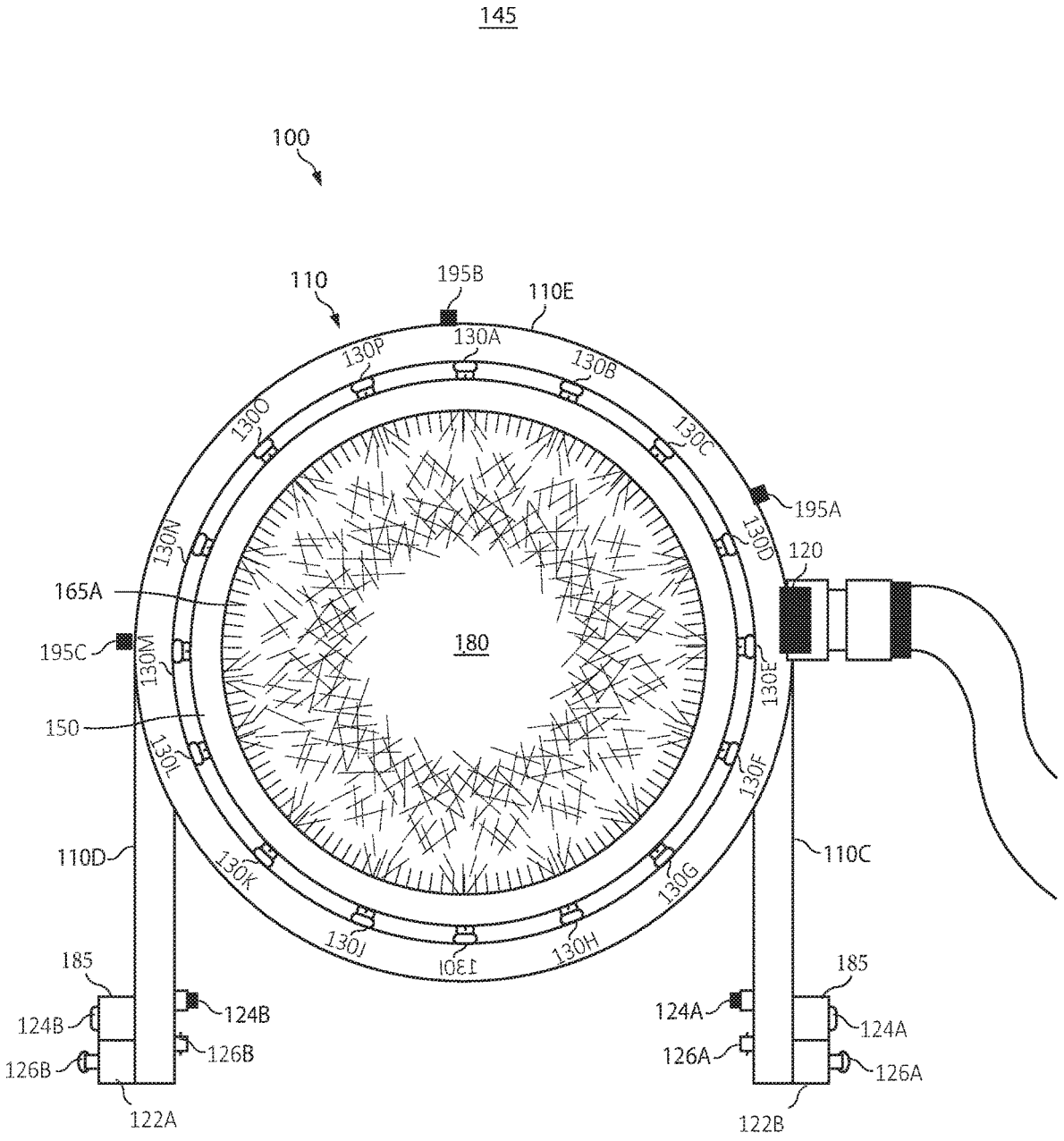
FIG. 1D is a perspective view an alternative fire hose washing device according to one embodiment of the present invention.

Turning now to FIG. 1D, the washing frame 110 may be circular, oval, or "round" in shape. For example, the washing frame 110 may include a substantially circular section 110E, and the two or more side pipe sections 110C and 110D disposed in parallel alignment with each other and coupled to the substantially circular section 110E. The substantially circular section 110E may include the apertures 130A-P that include one or more spray nozzles coupled to the one or more spray apertures 130A-P and targeted toward a zone encompassed by the washing frame 110. In an alternative aspect, the substantially circular section 110E may include the hose reception devices 150 (e.g., a rolling pin) coupled to the apertures 130A-P and the washing frame 110. For example, in one aspect, the hose reception device 150 may be coupled to a selected portion (e.g., an outer or inner portion) of the apertures 130A-P enabling the hose reception devices 150 to eject a liquid into the washing zone 180 without obstruction from the hose reception device 150. In an alternative aspect, the hose reception device 150 may selectively receive each of the apertures 130A-P enabling each of the apertures 130A-P to pass through a section (e.g., an opening on each side of the hose reception device 150) of the hose reception devices 150 to eject a liquid into the washing zone 180. The hose reception device 150 may also include one or more scrubbing brushes such as, for example, the scrubbing brushes 165A. Other components as described previously are omitted for the sake of brevity. It should be noted, however, that FIG. 1D is only one example configuration, of the washing frame 110 having a circular/round shape. Thus, alternative configurations may be employed using each of the previously described components.

Turning now to FIG. 2, diagram 200 depicts the fire hose washing device 100 of FIG. 1A is coupled to a hose 210 (e.g., a high-pressure fire hose) of a vehicle 250. In one aspect, the fire hose washing device 100 is detached from vehicle 250 but connected to the hose 210 that may be connected/coupled to the vehicle 250. In one aspect, the vehicle 250 may be an emergency response vehicle such as, for example, a fire truck. However, it should be noted that the vehicle 250 may be any vehicle, which may be coupled to one or more hoses such as, for example, hose 210.

In operation, the vehicle 250 may engage a water flow mechanism to disperse water through hose 210. Hose 210, being coupled to the fire hose washing device 100, may deliver a desired/selected amount of water through the washing frame 110. The spray apertures 130A-L may eject, disperse, or release the water traversing within the washing frame 110 at one or more angles and/or at one or more flow rates (e.g., in the washing zone 245). That is, the apertures 130A-F may be and/or include one or more spray nozzles coupled to the one or more spray apertures 130A-F and targeted toward a zone encompassed by the washing frame 110. The washing zone 245 may be a defined or created opening or inner region (e.g., of the washing frame 110). That is, the washing frame 110 defines an open volume (e.g., zone 245) to enable one or more additional (e.g., dirty/unclean hoses such as, for example, contaminated hose 220) to pass therethrough (e.g., pass through zone 245) to be sprayed and cleaned by the spray apertures 130A-F of the washing frame 110.

The spray apertures 130A-L may provide one or more types of spray patterns (e.g., solid stream, hollow cone, full cone, flat spray, etc.), spray capacity, spray impacts (e.g., impact (I) of a spray onto a target surface expressed as force (F) divided by area (A) (e.g., I=F/A)), spray angles and coverages (e.g., a spray angle that may diverge or converge with respect to the vertical axis such as, for example collapse or diverge with increasing distance from the spray apertures 130A-L), and/or spray drop size (e.g., the size of the spray drops that make up the spray pattern of the spray apertures 130A-F).

For example, a contaminated hose 220 (e.g., a hose having one or more contaminants, carcinogens, dirt, soot, ash, or other unwanted substance), having been recently used (e.g., to assist with a fire fighting operation) may need to be washed and cleaned prior to be stored on the vehicle 250 or other storage location, and may enter the zone 245 of the washing frame 110 using the hose reception devices 150 to be positioned thereon and selectively pass through the washing zone 245 of the washing frame 110 while being sprayed with the liquid via the spray apertures 130A-F.

The one or more computing devices 195A-C may detect the presence of the contaminated hose 220 within the washing zone 245. Additionally, the one or more computing devices 195A-C may detect, interpret, analyze, and/or identify the various contaminates on the contaminated hose 220. Upon detecting the contaminated hose 220 within the washing zone 245 and/or detecting the various contaminates on the contaminated hose 220, the one or more computing devices 195A-C may trigger a signal to a UE 295, which may be enabled with an application in communication with the fire hose cleaning device 100. The application may be enabled on the UE 295 to automatically trigger the release and/or activation of liquid through the washing device 110 via the spray apertures 130A-F. For example, upon detection of the contaminated hose 220 the UE 295 via the application may indicate a message "contaminated hose detected. Cleaning will now start." Alternatively, for example, the application may be located on one or more computing devices 195A-C, which may automatically trigger the release and/or activation of liquid through the washing device 110 via the spray apertures 130A-F.

Figure 3A:
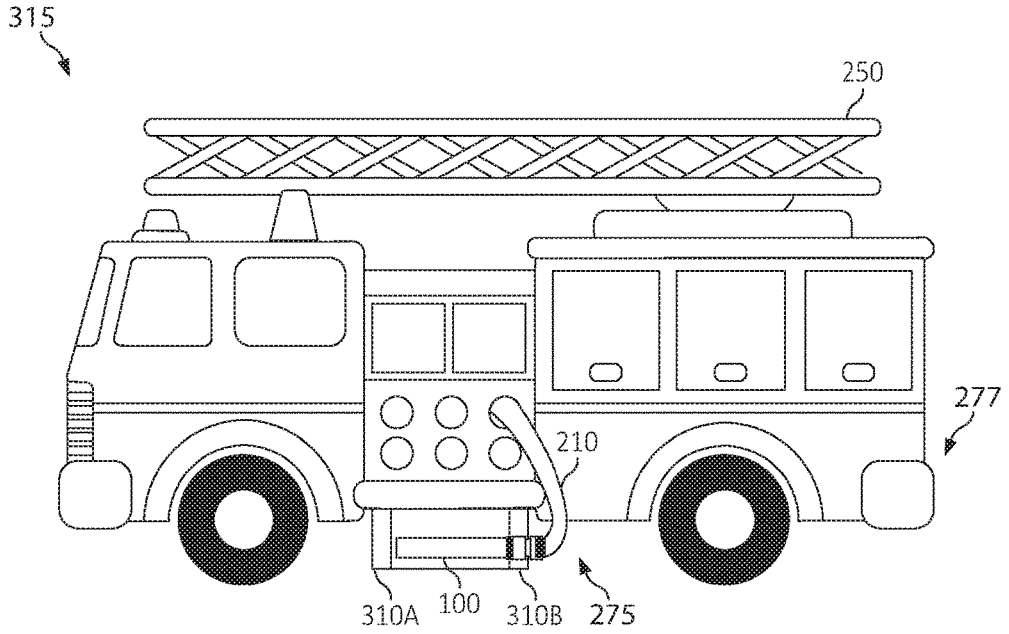
FIGS. 3A-3B is view of a fire hose washing device according to one embodiment of the present invention of FIG. 1A mounted to a vehicle according to one embodiment of the present invention.
Figure 3A:
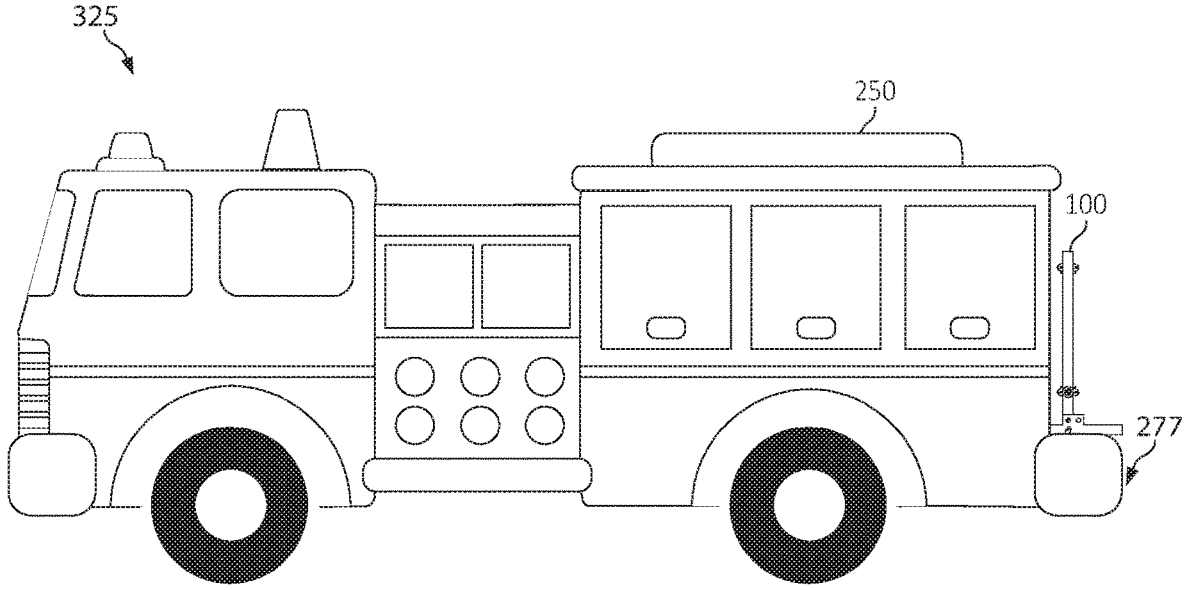
Figure 3B:
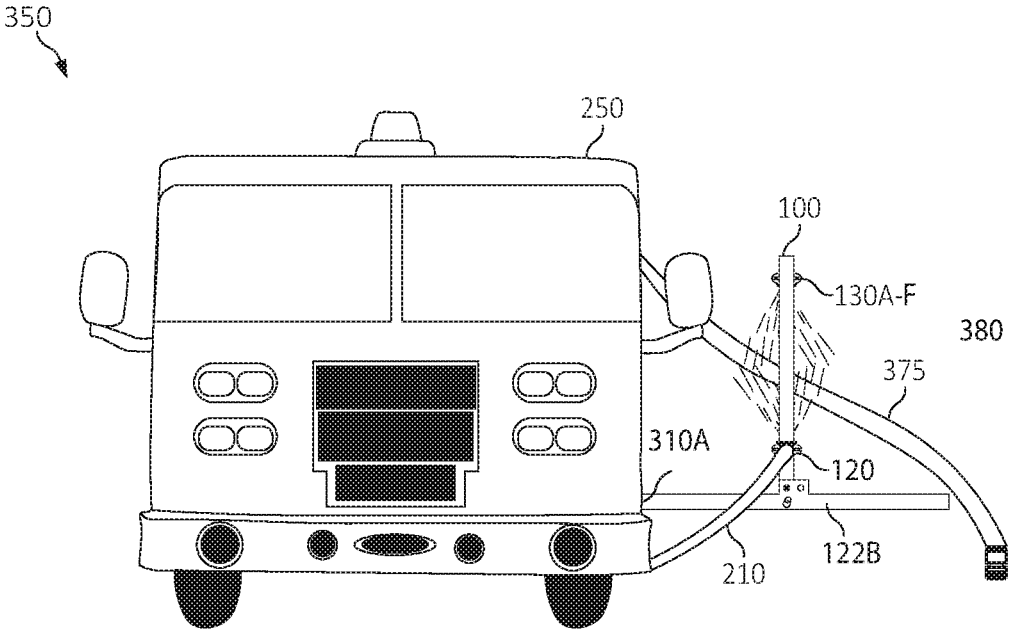
Figure 3C:
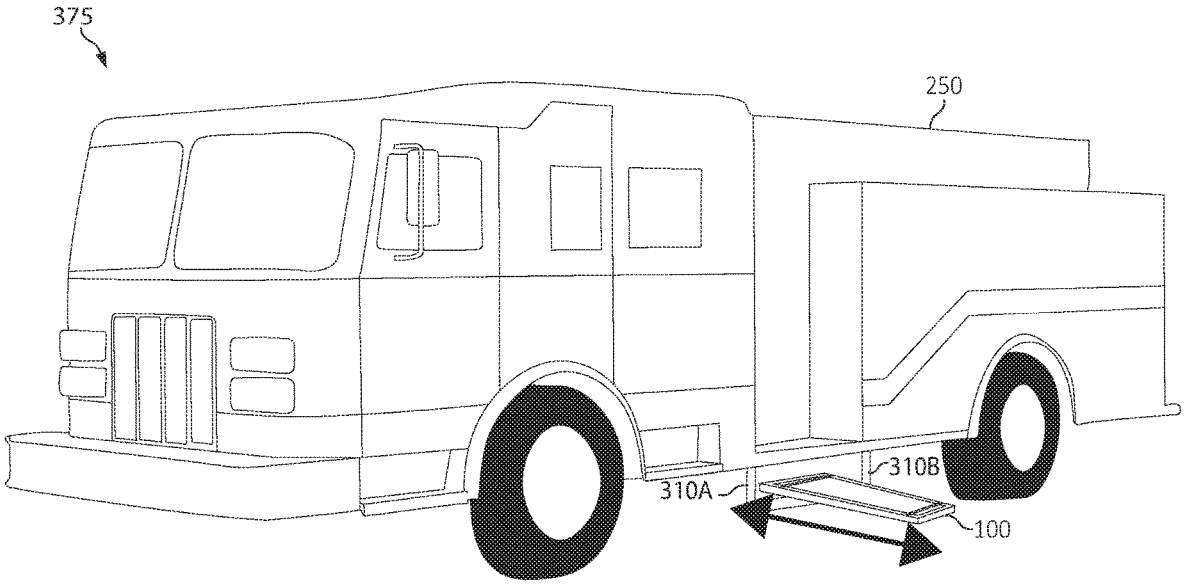
Figure 3C:
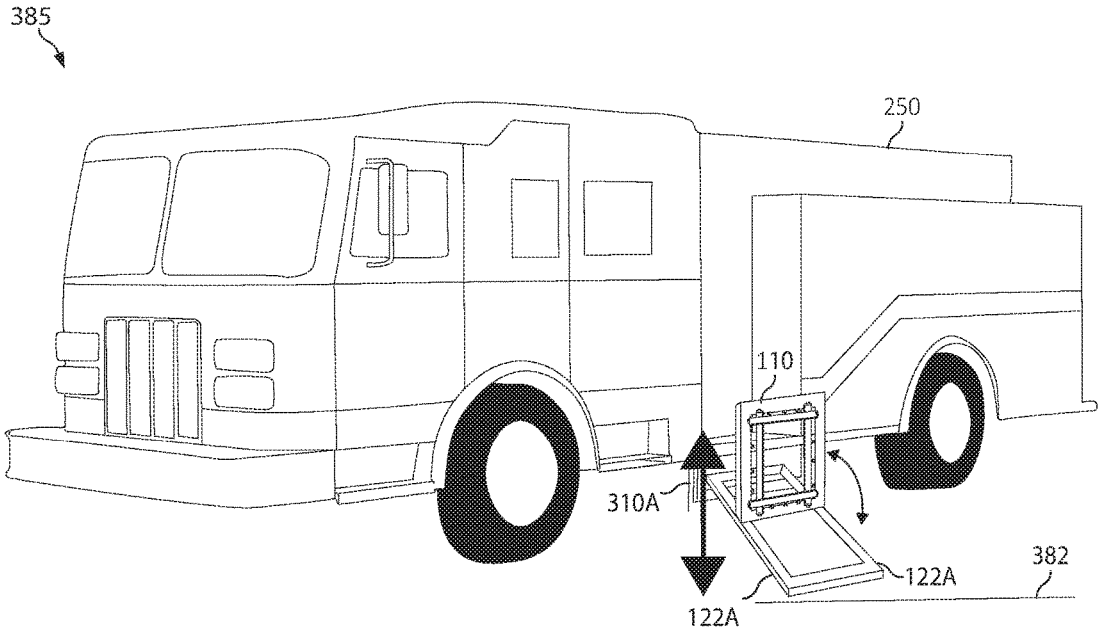

Turning now to FIGS. 3A-3C, diagrams 315, 325, 350, 375, and 385 are views of the fire hose washing device 100 mounted to the vehicle 250 of FIG. 2. Repetitive description of like elements employed in other embodiments described herein (e.g., FIGS. 1A-1D and FIG. 2) is omitted for sake of brevity. In one aspect, the vehicle 250 may be coupled to the fire hose washing device 100 at one or more locations of the vehicle 250 such as, for example, section 275. In one aspect, the section 275 may be a defined location/position (e.g., a center portion of the vehicle 250) along a side portion (e.g., section 275) of the vehicle 250, as illustrated in views 315, 325, 350, 375, and/or 385 of FIG. 3. Alternatively, the section 275 may be an alternative location/position at or near the rear (e.g., rear section 277) of the vehicle 250.

More specifically, the washing device 110 may include one or more connection means 310A-B coupled to the washing frame 110 for securing the fire hose washing device 100 to the section 275 and/or section 277 of the vehicle 250. In one aspect, the one or more connection means 310A-B may be coupled to the washing device 110 and/or the adjustable base sections 122A and 122B and permanently or temporarily coupled to the section 275 and/or section 277 of the vehicle 250. The one or more connection means 310A-B may be defined and/or configured to selectively rotate, urge forward, or retract the fire hose washing device 100 (e.g., the washing frame 110) towards and/or away from the vehicle 250.

For example, FIGS. 3B-3C illustrates the fire hose washing device 100 coupled to one or more connection means such as, for example, one or more connection means 310A and selectively urged forward away from the vehicle 250 in a "locking position" for enable firehose 375 to enter into the washing device 100. Alternatively, the fire hose washing device 100 may be urged reward towards from the vehicle 250 in a "locking position" for enabling the washing device 100 to be stored and secured for transport on the vehicle 250.

In one aspect, the one or more connection means 310A-B may be a removable hinge, a rotating locking clip, clip, rod, notch, pin, latch, rail system, or other pivot point allowing the adjustable base sections 122A and 122B to come apart and disconnect or separate from the section 275 of the vehicle 250. In one aspect, by way of example only, section 275 may be substantially located along a side portion (e.g., middle section) of the vehicle 250 and section 277 may be a rear section (e.g., a rear bumper) of the vehicle 250.

In an additional aspect, the one or more connection means 310A-B may be a securing channel traversing along at least a portion of one or more outer edges of adjustable base sections 122A and 122B that may be coupled to a securing device of the vehicle 250. The securing channel of the one or more connection means 310A-B enables the adjustable base sections 122A and 122B to slidably adjust (forwards and/or backward) to one or more locking positions while attached to the vehicle 250. For example, during movement of the vehicle 250, the securing channel of the one or more connection means 310A-B may enable the washing device 110 to be in a "stored position" by being slidably retracted in a backward/rearward direction and positioned in a concealed position of the vehicle 250 (e.g., concealed and underneath the section 275 of the vehicle). That is, the securing channel of the one or more connection means 310A-B may enable the washing device 110 to be stored underneath and in parallel to a bottom portion of the vehicle 250 without causing interference with one or more operating parts of the vehicle 250.

Once the vehicle 250 has stopped and it becomes desirable by a user to use the fire hose washing device 100, the securing channel of the one or more connection means 310A-B may enable the adjustable base sections 122A and 122B of the washing frame 110 to be in an "activated position" by being slidably adjusted and urged forward out from underneath the concealed positioned of the vehicle 250 (e.g., concealed and underneath the section 275 of the vehicle). Upon reaching a desired position, the adjustable base sections 122A and 122B may continue to be coupled to the vehicle 250 and also enable the washing device 110 to be selectively rotated to a selected angle (e.g., 45-degree angle in relation to the vehicle 250 and/or a ground surface 382, as illustrated in FIGS. 3B-3C. Additionally, view 385 depicts the washing frame 110 being rotated upward and away from the adjustable base sections 122A and 122B and is in a position perpendicular to the ground surface 382 and/or at one of a plurality of angles in relation to the adjustable base sections 122A and 122B. Thus, as illustrated in FIGS. 3A-3C, the washing device For example, view 385 illustrates the adjustable base sections 122A and 122B being in an downward, angled position (e.g., 45 degree angle in relation to a ground section while the fire hose washing device 100 may be 1) connected to a vehicle at one or more locations using one or more attachment means, 2) permanently and/or semi-permanently secured in one of a plurality of positions in relation to the vehicle 250 for being stored/secured for transport and/or used for cleaning a hose, and/or 3) rotationally adjusted in one of a plurality of angles in relation to the vehicle, a ground surface, or in relation to one or more components that comprises the fire hose washing device 100.

For example, at the selected angle position in views 350 and/or 385, a contaminated hose such as, for example, the hose 375, may enter the washing zone 245 of the washing frame 110 of FIG. 2 using the hose reception devices 150 to be positioned thereon and selectively pass through the zone 245 of the washing frame 110 while being sprayed with the liquid via the spray apertures 130A-L. The contaminated hose 375 may be washed clean via the spray apertures 130A-L while traversing through the zone 245 while being retracted and stored onto vehicle 250.

As an additional example, the one or more connection means 310A-B may be a rotating mechanism with locking capabilities whereby the adjustable base sections 122A and 122B of the washing device 110 may be coupled to the vehicle via the one or more connection means 310A-B. In this way, the one or more connection means 310A-B enable to be stored in an upright position ("stored position") (e.g., the fire hose washing device 100 being in an upright and standing position as illustrated in FIG. 1A) such as, for example, as illustrated in view 325 of FIG. A Again, upon a user desiring to use the fire hose washing device 100, the one or more connection means 310A-B (e.g., a rotating mechanism with locking capabilities) enable the washing device 110 to rotationally pivot or swing forward, upward, downward, and/or rearward (e.g., the washing device 110 releases from a fixed position and rotationally pivots in a downward direction away from the vehicle) and/or closes (e.g., the washing device 110 returns to a fixed position by rotationally pivoting in an upward direction toward the vehicle 245) to a desired position (e.g., a 45 degree angle in relation to the ground and/or vehicle 250).

Again, at the selected angle position, a contaminated hose 375 may enter the zone 245 of the washing frame 110 of FIG. 2 using the hose reception devices 150 to be positioned thereon and selectively pass through the zone 245 of the washing frame 110 while being sprayed with the liquid via the spray apertures 130A-L. The contaminated hose 375 may be washed clean via the spray apertures 130A-L while traversing through the zone 245 while being retracted and stored onto vehicle 250.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

The invention claimed is:

1. An apparatus, comprising:

a detachable washing frame comprising pipe tubing having one or more spray apertures for discharging a liquid;

one or more hose connector coupled to the detachable washing frame, wherein the one or more hose connector are configured to receive an external source that delivers the liquid to pass through the pipe tubing;

a hose reception device coupled to the detachable washing frame, wherein the hose reception device enables a hose to be positioned thereon and selectively pass through the detachable washing frame while being sprayed with the liquid;

at least one adjustable base section coupled to the detachable washing frame, wherein the at least one adjustable base section is configured to enable the detachable washing frame to be selectively rotated, positioned, and urged towards or away from a vehicle; and a first one or more connection means temporarily coupled to the at least one adjustable base section and the detachable washing frame, a second first more connection means coupling the at least one adjustable base section to the vehicle, and a third one or more connection means connecting the at least one adjustable base section to the detachable washing frame, wherein the third one or more connection means are configured to set the at least one adjustable base section in a locked position and configured to be released from the at least one adjustable base section while the at least one adjustable base section remains secured to the vehicle.

2. The apparatus of claim 1, wherein the at least one adjustable base section is configured to support the detachable washing frame in a fixed, upright position while detached from the vehicle set in the locked position on the vehicle.

3. The apparatus of claim 2, wherein the second one or more connection means include one or more securing channels and configured to enable the at least one adjustable base section to slidably adjust and position the detachable washing frame on the vehicle, the second one or more connection means configured to enable the detachable washing frame to be set in a concealed position within or underneath the vehicle.

4. The apparatus of claim 1, wherein the pipe tubing is configured in one of a plurality of geometric shapes and sizes to form the detachable washing frame; wherein the one of a plurality of geometric shapes enable the detachable washing frame to form a washing zone encompassed by the detachable washing frame for discharging the liquid towards at least the hose reception device in the washing zone.

5. The apparatus of claim 1, wherein the hose reception device comprises a pair of cylinders disposed in parallel alignment, wherein the hose reception device enables a fire hose to selectively pass through the detachable washing frame to be sprayed with the liquid that is discharged.

6. The apparatus of claim 1, further including one or more spray nozzles that are coupled to the one or more spray apertures, wherein the one or more spray nozzles are position toward a target zone encompassed by the detachable washing frame.

7. The apparatus of claim 1, further including one or more scrubbing brushes coupled to the detachable washing frame.

8. The apparatus of claim 1, further including one or more sensor devices configured to detect the hose entering the detachable washing frame, wherein the one or more sensor devices communicates a signal to a computing system where the computing system configured to automatically activate a flow of liquid from the external source upon receiving a signal from the one or more sensor.

9. A fire hose cleaning apparatus, comprising:

a detachable washing frame comprising a piping system having one or more spray apertures for discharging a liquid to clean a fire hose, the piping system comprising:

a base pipe section; and two or more side pipe sections disposed in parallel alignment coupled to the base section;

a top pipe section disposed in parallel alignment with the base pipe section and coupled to the two or more side pipe sections;

one or more hose adapters coupled to the detachable washing frame, wherein the one or more hose adapters are configured to connect to an open end of a hose to receive the liquid to pass through the detachable washing frame;

one or more hose reception devices coupled to the two or more side pipe sections, wherein the one or more hose reception devices enables the fire hose to be positioned thereon and selectively pass through the detachable washing frame while being sprayed with the liquid;

at least one adjustable base section coupled to the detachable washing frame, wherein the at least one adjustable base section is configured to enable the detachable washing frame to be selectively rotated, positioned, and urged towards or away from a vehicle; and a first one or more connection means temporarily coupled to the at least one adjustable base section and the detachable washing frame, a second first more connection means coupling the at least one adjustable base section to the vehicle, and a third one or more connection means connecting the at least one adjustable base section to the detachable washing frame, wherein the third one or more connection means are configured to set the at least one adjustable base section in a locked position and configured to be released from the at least one adjustable base section while the at least one adjustable base section remains secured to the vehicle.

10. The fire hose cleaning apparatus of claim 9, wherein the at least one adjustable base section is configured to support the detachable washing frame in a fixed position.

11. The fire hose cleaning apparatus of claim 9, wherein the second one or more connection means include one or more securing channels and configured to enable the at least one adjustable base section to slidably adjust and position the detachable washing frame on the vehicle, the second one or more connection means are configured to enable the detachable washing frame to be set in a concealed position within or underneath the vehicle.

12. The fire hose cleaning apparatus of claim 9, further including at least one connection means coupled to the detachable washing frame and a section of a vehicle.

13. The fire hose cleaning apparatus of claim 9, further including at least one connection means coupled to the detachable washing frame and permanently or temporarily coupled to a section of a vehicle, wherein the at least one connection means configured to selectively rotate, urge forward, or retract the detachable washing frame towards or away from the vehicle.

14. The fire hose cleaning apparatus of claim 9, further including:

one or more spray nozzles coupled to the one or more spray apertures, wherein the one or more spray nozzles targeted toward a zone encompassed by the detachable washing frame; or one or more scrubbing brushes coupled to the detachable washing frame.

15. The fire hose cleaning apparatus of claim 9, further including one or more internet of things ("IoT") sensor devices coupled to the detachable washing framed and configured to detect the fire hose entering the detachable washing frame, wherein the one or more IoT sensor devices communicate a signal to an external source to activate a flow of the liquid from the external source.

16. An apparatus, comprising:

a detachable washing frame having one or more spray apertures for discharging a liquid;

one or more hose connectors coupled to the detachable washing frame, wherein the one or more hose connectors are configured to receive an external source that delivers the liquid to pass through the detachable washing frame;

a hose reception device coupled to the detachable washing frame, wherein the hose reception device enables a hose to be positioned thereon and selectively pass through the detachable washing frame while being sprayed with the liquid;

at least one adjustable base section coupled to the detachable washing frame, wherein the at least one adjustable base section is configured to enable the detachable washing frame to be selectively rotated, positioned, and urged towards or away from the vehicle; and a first one or more connection means temporarily coupled to the at least one adjustable base section and the detachable washing frame, a second first more connection means coupling the at least one adjustable base section to the vehicle, and a third one or more connection means connecting the at least one adjustable base section to the detachable washing frame, wherein the third one or more connection means are configured to set the at least one adjustable base section in a locked position and configured to be released from the at least one adjustable base section while the at least one adjustable base section remains secured to the vehicle.

17. The apparatus of claim 16, wherein the second one or more connection means include one or more securing channels and configured to enable the at least one adjustable base section to slidably adjust and position the detachable washing frame on the vehicle.

18. The apparatus of claim 16, wherein the second one or more connection means are configured to the enable the detachable washing frame to be set in a concealed position within or underneath the vehicle.

19. The apparatus of claim 16, wherein the detachable washing frame is configured in one of a plurality of geometric shapes and sizes; wherein the one of a plurality of geometric shapes enable the detachable washing frame to form a washing zone for discharging the liquid towards at least the hose reception device passing in and through the washing zone of the detachable washing frame.

20. The apparatus of claim 16, wherein the detachable washing frame is a piping system forming a washing zone for discharging the liquid towards at least the hose reception device, the piping system comprising:

a base pipe section;

two or more side pipe sections disposed in parallel alignment coupled to the base section and a top pipe section disposed in parallel alignment with the base pipe section and coupled to the two or more side pipe sections.

* * * * *